United States Patent [19]

Sayles

[11] Patent Number: 4,949,641

[45] Date of Patent: Aug. 21, 1990

[54] METHOD OF SAFELY DETOXIFYING MUSTARD GASES

[75] Inventor: David C. Sayles, Huntsville, Ala.

[73] Assignee: The United States of America as represented by the Secretary of the Army, Washington, D.C.

[21] Appl. No.: 488,545

[22] Filed: Mar. 5, 1990

[51] Int. Cl.[5] ..... C06D 7/00

[52] U.S. Cl. ..... 102/293; 86/11; 149/27; 149/40; 149/93; 149/19.4; 149/19.9; 149/109.6; 149/124; 264/3.1; 89/1.11

[58] Field of Search ..... 149/109.6, 124, 19.4, 149/19.9, 27, 40, 93; 86/1.1; 264/3.1; 89/1.11; 102/293

[56] References Cited

U.S. PATENT DOCUMENTS

| | | | |
|---|---|---|---|
| H223 | 3/1987 | Seidens et al. | 422/1 |
| H489 | 7/1988 | Brodman et al. | 102/293 |
| 4,594,239 | 6/1986 | Pluim | 424/10 |
| 4,784,699 | 11/1988 | Cowsar et al. | 134/11 |

*Primary Examiner*—Stephen J. Lechert, Jr.

*Attorney, Agent, or Firm*—Freddie M. Bush; James T. Deaton

[57] ABSTRACT

A method of safely detoxifying mustard gases comprises reacting the gases by a first reaction with incandescent pyrophoric metallic powder compounded in specific formulation. A second reaction enhances the neutralization of the toxicity of the mustard gases by thermal pyrolysis or deflagration. To accomplish the basic reaction which results in formation of thiacyclopentane, aluminum powder which is a preferred incandescent, pyrophoric metallic powder, is compounded in a basic formulation of aluminum powder, a binder, a curing agent, oxidizing agent, and burn rate catalyst. Examples of detoxification formulation which accomplishes the first reaction as well as a second reaction which enhances the neutralization of the toxicity of the mustard gases or toxic chemical agents by thermal pyrolysis or deflagration are shown under Table II and Table III. Table III formulation is preferred for detoxifying toxic chemical agents since it is formulated to enhance thermal pyrolysis and deflagration which generates high temperatures to ensure that the aluminum reacts extremely rapidly with the halogens in the toxic chemical agents.

4 Claims, No Drawings

METHOD OF SAFELY DETOXIFYING MUSTARD GASES

DEDICATORY CLAUSE

The invention described herein may be manufactured, used, and licensed by or for the Government for governmental purposes without the payment to me of any royalties thereon.

BACKGROUND OF THE INVENTION

The current method used in the destruction of demilitarized munitions containing toxic chemical agents is by combustion in specially designed furnaces. Complete combustion is essential in this method, and this method requires the passage of the effluent gases through exhaust scrubbers.

A method to detoxify toxic chemical warfare agents referred to as the Mustard Gases by a method wherein the toxic chemical is neutralized as a result of reacting it with a special reactant formulation to yield non-toxic products would be particularly attractive due to present environmental constraints against polluting the environment.

SUMMARY OF THE INVENTION

Toxic chemical warfare agents, referred to as mustard gases, when subjected to detoxification reactions which neutralize the toxicity would be attractive, particularly, if the reactions result in formation of compounds which are non-toxic.

An object of this invention is to provide a method of safely detoxifying mustard gases.

The method of safely detoxifying mustard gases comprises of reacting the mustard gases with incandescent pyrophoric metallic powder by a first reaction. Aluminum powder is a preferred choice due to cost and ready availability. A second reaction enhances the neutralization of the toxicity of the mustard gases by thermal pyrolysis or deflagration. To accomplish both reactions, the aluminum powder is compounded into a special formulation. The basic formulation for the first action is comprised of aluminum powder, binder and curing agent, oxidizing agent, and burn rate catalyst. The second reaction is accomplished by high temperature and thermal deflagration conditions which bring about the thermal deflagration of any unreacted toxic agent and of the intermediate products produced by the reaction with the aluminum.

Table I depicts the structural formulas of mustard gases having trivial name designations of (HO), (HN-1), (HN-2) and (HN-3).

TABLE I

STRUCTURAL FORMULAS AND TRIVIAL NAME DESIGNATION OF MUSTARD GASES

| STRUCTUAL FORMULAS | TRIVIAL NAME DESIGNATION |
|---|---|
| $(ClCH_2.CH_2)_2S$ | (HO) |
| $(ClCH_2.CH_2)_2N.Et$ | (HN-1) |
| $(ClCH_2.CH_2)_2N.Me$ | (HN-2) |
| $(Cl.CH_2.CH_2)_3\ N$ | (HN-3) |

Aluminum powder is compounded into special formulations which are presented in Tables II and III hereinbelow under "Description of the Preferred Embodiment".

Detoxification is accomplished by the neutralization of the toxicity of the toxic chemical agent by reaction of the aluminum with chlorine atoms of the toxic chemical agent. With the mustard gases, substituted thiacyclopentanes are the primary products that are produced. The simplest reaction involves that of aluminum with mustard gas (HO), which results in the formation of thiacyclopentane. HN-1 will form the N-ethylazacyclopentane. This reaction is depicted under Example I below. HN-2 will form the N-methylazacyclopentane, and HN-3 will form N-chloroethylazacyclopentane.

Example I: Simplest Reaction of Aluminum with Mustard Gas (HO)

Reaction of aluminum powder with mustard gas (HO) is depicted as follows:

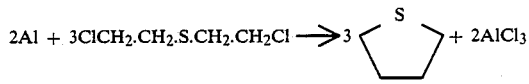

Detoxifying mustard gases is achieved in accordance with this invention by reacting mustard gases with an incandescent pyrophoric metallic powder by a first reaction. Aluminum powder is a preferred choice due to cost and ready availability. A second reaction enhances the neutralization of the toxicity of the mustard gases by thermal pyrolysis or deflagration.

Deflagration is a mode of reaction in which the sustaining energy is propagated by thermal conduction, and radiation, occurring subsonically with respect to the undisturbed material; the direction of flow of the reaction products is opposite to that of the propagation of the disturbance.

Representative of a basic formulation for the first reaction is the formulation comprised of aluminum powder (which functions as the incandescent pyrophoric metallic powder), a binder, a curing agent, an oxidizing agent, and a burn rate catalyst. An example of detoxification formulations which accomplishes both reactions are set forth in Tables II and III below. Table II below sets forth a composition for detoxification of mustard gases.

TABLE II

COMPOSITION OF MUSTARD GASES DETOXIFICATION FORMULATION

| INGREDIENT | PARTS BY WEIGHTS |
|---|---|
| Hydroxyl-terminated polybutadiene prepolymer | 10 |
| Isophorone diisocyanate* | |
| Aluminum powder | 35 |
| Ammonium perohlorate (200-Micrometers) | 52 |
| Ferric oxide | 3 |

The method of compounding this composition is by mechanically mixing all of the ingredients into the hydroxyl-terminated polybutadiene prepolymer, except for the isophorone diisocyanate. The diisocyanate is added last, after the other ingredients have been thoroughly mixed and incorporated.

*Isocyanate-to-hydroxyl ratio is 0.95

Table III depicts a detoxifying composition which can be manufactured as pressed pellets.

TABLE III

CHEMICAL COMPOSITION FOR DETOXIFYING TOXIC CHEMICAL AGENTS

| | |
|---|---|
| Antimony sulfide | 15.0% |
| Aluminum powder | 39.0% |
| Pentaerythritol tetranitrate | 5.0% |
| Tetracene | 4.0% |
| Lead styphnate | 37.0% |

TABLE III-continued

| CHEMICAL COMPOSITION FOR DETOXIFYING TOXIC CHEMICAL AGENTS | |
|---|---|
| Gum Arabic | 0.2%* |

*105 ml of 1% solution of Gum Arabic used per 3.5 kg of destroying mixture.

Table III chemical composition is a preferred composition for detoxifying toxic chemical agents under reaction conditions and the method steps described below.

Because of the necessity of generating high temperatures to ensure that the aluminum reacts extremely rapidly with the halogens in the toxic chemical agents, the formulation which is presented in Table III was developed. The high temperatures bring about the thermal deflagration of any unreacted toxic agent and the intermediate products produced by the reaction with the aluminum.

The procedure for destruction of munition containing toxic chemical agents is described as follows:

(a) the munition is placed in a chamber capable of being evacuated and having a predetermined size for receiving and containing the munition having a casing for containing mustard gases or toxic chemical agents within the munition casing;

(b) a formulation containing an incandescent pyrophoric metallic powder is placed within the chamber;

(c) an igniter charge is placed in the chamber and in contact with the formulation for igniting the formulation containing the pyrophoric metallic powder;

(d) the chamber is evacuated;

(e) the munition's casing is remotely drilled open, and the toxic agent allowed to escape into the evacuated chamber;

(f) the igniter charge (which can be any closed rocket igniter charge or electrically initiated squib) is ignited initiating the combustion of the heavily-aluminized detoxification composition and the toxic chemical agent. This process is enhanced because the aluminized detoxification composition produces ultrahigh combustion temperatures which accelerate the chemical reactions.

I claim:

1. A method of safely detoxifying mustard gases and chemical agents by completing a first reaction with an incandescent pyrophoric metallic powder compounded in a selected, specific formulation to form reaction products and by completing a second reaction including a deflagration reaction to generate extremely high temperatures to bring about thermal deflagration of any unreacted toxic agent and the intermediate products produced by said first reaction with the incandescent pyrophoric metallic powder, said method comprising:

(i) providing a chamber capable of being evacuated, said chamber having a predetermined size for receiving and containing munition having a casing for containing mustard gases or toxic chemical agents within said munition casing;

(ii) placing said munition within said chamber;

(iii) placing a formulation containing an incandescent pyrophoric metallic powder within said chamber, said formulation selected from the formulations A and B set forth hereinbelow as follows:

Formulation A

| Ingredient | Parts by Weight |
|---|---|
| Hydroxyl-terminated polybutadiene prepolymer | 10 |
| Isophorone diisocyanate (isocyanate - to hydroxyl ratio = 0.95) | |
| Pyrophoric metallic powder | 35 |
| Ammonium perchlorate (200-Micrometers) | 52 |
| Ferric oxide | 3 |

Formulation B

| | |
|---|---|
| Antimony sulfide | 15.0% |
| Pyrophoric metallic powder | 39.0% |
| Pentaerythritol tetranitrate | 5.0% |
| Tetracene | 4.0% |
| Lead styphnate | 37.0% |
| Gum Arabic (105 milliliters of 1% solution per 3.05 Kg of formulation) | 0.2% |

(iv) placing an igniter charge in said chamber and in contact with said formulation for igniting said formulation containing said pyrophoric metallic powder;

(v) evacuating said chamber;

(vi) remotely drilling said munition casing to allow said mustard gases or said toxic chemical agents to escape into said evacuated chamber; and, (vii) igniting said igniter charge thereby initiating the combustion of said formulation containing said pyrophoric metallic powder to accomplish a first and second reaction process, said first reaction process detoxifying said mustard gases or said toxic chemical agents by forming reaction products of said mustard gases or said toxic chemical agents and said pyrophoric metallic powder, and said second reaction process generating higher temperature reactions which enhance the neutralization of the toxicity of said mustard gases and said toxic chemical agents by thermal pyrolysis or deflagration of any unreacted toxic chemical agent and of the intermediate products produced by said reaction with said pyrophoric metallic powder.

2. The method, as defined in claim 1, wherein said pyrophoric metallic powder contained in said formulation in aluminum.

3. The method, as defined in claim 2, wherein said formulation selected is said formulation A and wherein said munition contains a mustard gas having the chemical formula selected from the group consisting of $(ClCH_2.CH_2)_2S$, $(ClCH_2.CH_2)_2N.Et$ $(ClCH_2.CH_2)_2N.Me$, and $(Cl.CH_2.CH_2)_3N$, said mustard gas chemical formula having trivial names as designated by (HO), (HN-1), HN-2), and (HN-3) respectively.

4. The method, as defined claim 2, wherein said formulation selected is said formulation B and wherein said munition contains a mustard gas having the chemical formula selected from the group consisting of $(ClCH_2.CH_2)_2S$, $(ClCH_2.CH_2)_2N.Et$, $(ClCH_2.CH_2)_2N.Me$, and $(ClCH_2CH_2)_3N$, said mustard gas chemical formula having the trivial names of (HO), (HN-1), (HN-2), and (HN-3) respectively.

* * * * *